US008205846B2

(12) United States Patent
Glunk

(10) Patent No.: US 8,205,846 B2
(45) Date of Patent: Jun. 26, 2012

(54) MAGNETIC HOLDING DEVICE FOR A SHOWER DEVICE ON A ROD

(75) Inventor: Guenter Glunk, Fluorn-Winzeln (DE)

(73) Assignee: Hansgrohe AG, Schiltach (DE)

( * ) Notice: Subject to any disclaimer, the term of this patent is extended or adjusted under 35 U.S.C. 154(b) by 323 days.

(21) Appl. No.: 12/544,787

(22) Filed: Aug. 20, 2009

(65) Prior Publication Data

US 2009/0302181 A1 Dec. 10, 2009

Related U.S. Application Data

(63) Continuation-in-part of application No. PCT/EP2008/001553, filed on Feb. 28, 2008.

(30) Foreign Application Priority Data

Mar. 2, 2007 (DE) ..... 10 2007 011 599

(51) Int. Cl.
*A47G 1/17* (2006.01)

(52) U.S. Cl. ..... 248/309.4; 248/206.5

(58) Field of Classification Search ..... 248/206.5, 248/309.4, 683, 218.4, 219.3, 219.4, 295.11; 4/605, 611, 596; 16/87.2, 82; 24/303
See application file for complete search history.

(56) References Cited

U.S. PATENT DOCUMENTS

| | | | | |
|---|---|---|---|---|
| 4,651,720 | A | 3/1987 | Baus | |
| 5,277,391 | A | 1/1994 | Haug et al. | |
| 5,746,329 | A * | 5/1998 | Rondeau | 211/123 |
| 7,108,461 | B1 * | 9/2006 | Colburn et al. | 409/131 |
| 7,699,277 | B2 * | 4/2010 | Bagnall | 248/206.5 |
| 7,810,265 | B2 * | 10/2010 | Beatty | 40/607.14 |

FOREIGN PATENT DOCUMENTS

| | | | |
|---|---|---|---|
| DE | 1489255 | A1 | 8/1969 |
| DE | 4000621 | A1 | 7/1991 |
| DE | 10260207 | A1 | 6/2004 |
| EP | 0091032 | A2 | 10/1982 |
| FR | 2197395 | A | 3/1974 |
| NL | 1028853 | C1 | 10/2006 |

OTHER PUBLICATIONS

European Patent Office, International Search Report of PCT/EP2008/001553, May 28, 2008.

German Patent and Trademark Office, German Search Report, German Patent Appln. No. 10 2007 011 599.9, Issued Jan. 14, 2008.

* cited by examiner

*Primary Examiner* — A. Joseph Wujciak, III
(74) *Attorney, Agent, or Firm* — Duane Morris LLP

(57) ABSTRACT

A holding device for a shower device has a holder for the shower device that may be attached to and displaced along a hollow rod, the holder surrounding the rod in a collar-like manner. A displaceable carriage having a certain frictional effect and comprising two magnets is disposed in the rod. The holder has two magnets for attachment on the rod such that, in the holding position, the magnets of the carriage interact with the magnets of the holder under a magnetic attractive force so as to prevent the holder from sliding downward because a clamping or frictional effect results from the attractive force of the magnets.

18 Claims, 3 Drawing Sheets

MAGNETIC HOLDING DEVICE FOR A SHOWER DEVICE ON A ROD

CROSS REFERENCE TO RELATED APPLICATION

Figure 2:
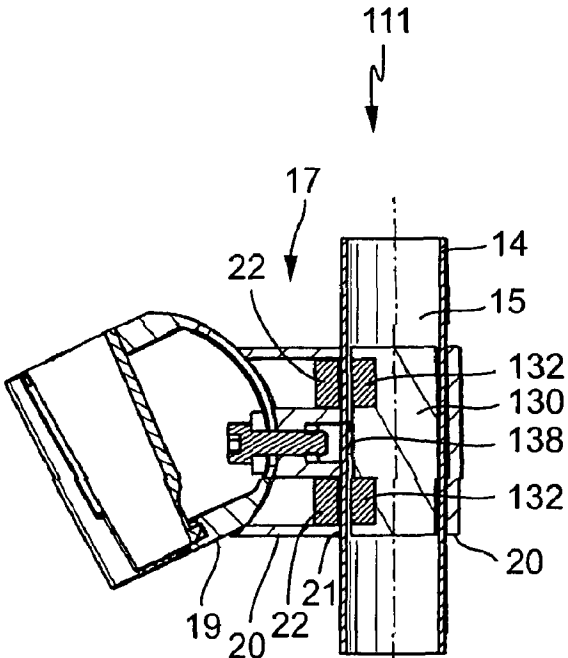

This is a continuation of international application PCT/EP2008/001553, filed 28 Feb. 2008, claiming priority of application DE 10 2007 011 599.9, filed 2 Mar. 2007 in Germany.

FIELD OF APPLICATION AND PRIOR ART

The invention relates to a holding device for a shower device like a hand shower, wherein the holding device is attached to a rod.

Numerous slide fittings for shower rods are known, for instance, from U.S. Pat. No. 5,277,391 or DE 40 00 621 A, in which a holder like a slider holds a hand-held shower device and is secured against slippage by clamping on the rod from the outside. Through the force applied by a user, the clamping effect can be deactivated and the holder can be displaced along the rod or if necessary it can also be rotated.

Problematic hereby is that setting a clamping device to different manufacturing tolerances for both of the rod as well as of the holder and under circumstances of the clamping device itself, are necessary, which must be carried out separately for each individual holding device. Moreover, the clamping or frictional effect of a dry rod can be very different than that of a wet rod, so that in one case, the clamping effect under certain circumstances is much stronger than is necessary and in another case it is at the limit of weakness.

PROBLEM AND SOLUTION

The invention is based on the problem of providing a holding device as mentioned above, with which the problems of the state of the art can be avoided and particularly with which a holder for a shower device on a rod is possible, which is simple to adjust and comfortable to use.

This problem is solved by means of a holding device with the features of Claim 1. Advantageous as well as preferred embodiments of the invention are object of the further claims and are explained in detail in following. The wording of the claims is based on express reference to the content of the description. Moreover, the wording of priority application DE 102007011599.9 dated Mar. 2, 2007 by the same applicant is made part of the present description through express reference to the content.

The rod of the holding device is fixed on a wall or similar surface, advantageously with vertical alignment. It is hollow or features an internal cavity as is common for such rods for holding shower devices. The holding device features a holder for the shower device, which is attachable to the rod, wherein the holder can be moved or shifted on the rod, in particular for height adjustment. The shower device is advantageously attachable by clamping or inserting it in an opening on the holding device or on a holder; it can therefore be removed. According to the invention, a carriage is located inside the rod, which is disposed in a slidable manner therein, wherein the sliding possibility counteracts a certain clamping or a frictional effect. This means that the carriage can only be moved by application of force. The carriage features at least one magnet or magnetic element. The holder surrounds the rod and also features at least one magnet or magnetic element, wherein either a holder and/or a magnet is provided on the carriage, thus, two magnetic elements should not interact. In the following description only one magnet is mentioned, wherein it is thus assumed, though, that this comprises magnets and magnetic elements made of ferromagnetic materials, but with two interacting elements at least one is always a magnet or a permanent magnet.

The magnets are provided in such a manner that the holder can be attached to the rod such that in a holding position of the holding device the magnet on the carriage interacts with the magnet on the holder. The magnet on the carriage thus holds the magnet on the holder and thus prevents the holder from slipping or falling. The carriage itself is held in the rod advantageously by its own frictional or clamping effect, wherein this clamping effect or frictional effect can still be increased particularly advantageously by the attractive force of the magnets.

This makes it possible that a holder for the shower device is attached on the rod by clamping or frictional effect. However, this is mainly caused by the carriage, and since this is inside the rod, the same conditions prevail constantly, thus, there is no change between dampness and dryness, which calls for complex adjustment. Due to the holding force of the magnets, the holder can be fixed through the rod or through its wall. In an embodiment of the invention, the holder can surround the rod in a collar-like manner and, for instance, feature further apparatus for creating an increased frictional effect relative to the rod for preventing further slippage; however, this is not mandatory. This will be discussed in detail in the following passage.

In an advantageous embodiment of the invention at least one magnet is adjusted on the carriage and at least one magnet on the holder in such a manner that they feature a distance that is as small as possible from one another in the holding position of the holding device. Advantageously, they are thereby essentially held with a distance from one another that is equal to or more than the thickness of the rod.

In a further embodiment of the invention, several magnets are advantageously provided on the carriage and thus on the holder and particularly advantageously distributed on the rod in the sliding direction the carriage. At least two or more magnets can be used. The magnets on the carriage and on the holder should extend more or less or possibly far apart along this sliding direction in order to improve the holding effect as much as possible. In this way, they can be provided, for instance, respectively on or near one end of the carriage, thus at the top and bottom. The magnets on the holder are particularly advantageously disposed exactly as on the carriage.

The magnets are advantageously attached to the carriage on the side towards the shower device to be attached to the holder. In an embodiment of the invention, a tipping moment of a holder attached to the rod can be considered, and, in addition, a top magnet can be provided on the rear side of the carriage and a bottom magnet on the front side of the carriage. Matching magnets are provided on the holder, since the smallest possible distance can be attained here respectively between corresponding magnets on the carriage and holder.

In an embodiment of the invention, it can be provided that a frictional effect of the carriage occurs on the rod as a permanent frictional resistance or as a kind of frictional brake. For this, projections and/or sections made of elastic material can be provided, which press the carriage against the rod. For instance, elastomers such as rubber or similar materials are recommendable. These can develop a frictional effect which acts punctually on several points of the carriage or at least at one point in an essentially ring-shaped manner around the carriage. Moreover, its elasticity or dimension should be such that, also due to production tolerances, it somewhat exhibits the same frictional effect for the rod, for the carriage and for itself.

In an alternative embodiment of the invention, a frictional brake can be formed in such a manner that its essential frictional effect occurs through the attractive forces of the carriage magnets and holder magnets or their attractive effect can be activated or at least influenced by it. This means that the magnets on the carriage and holder attract one another in the holding position and hence the carriage presses towards the holder and against the rod, so that projections and/or sections made of the above-mentioned elastic material with high frictional effect are advantageously provided here. Hereby the carriage can have so much clearance inside the rod under certain circumstances that it does not drop under its own weight. Only if the magnets on the holder and the carriage with its magnets pull or press against the rod does such a frictional brake become active with its main frictional effect. This allows a substantial independence from production tolerances, since this defined frictional effect does not depend on influences such as the diameter of the rod or the diameter of the carriage which is subjected to greater production tolerances.

In an additional embodiment of the invention, a further frictional brake can be provided on the holder itself, thus on the outside of the rod. This can either act permanently or be caused through torque that prevails when the shower device is held, if an operator releases the holder after possible adjustment. After all, a frictional brake on the holder can likewise be reinforced or even be activated by the attractive force of the magnets, as already explained above in a similar case for a frictional brake on the carriage.

In an embodiment of the invention, a freewheeling device can be provided, which makes movement of the holder together with the carriage in one direction easier than in the other. Therewith it can be achieved that an upwards displacement is easily possible. Here, a greater force must not be applied by the holding device downwards so that the holder does not slip downwards along the rod. It is possible that the freewheeling device is only active or effective in a sliding position when the holder is fixed on the rod.

In accordance with an embodiment of the invention, the freewheeling device is formed on the carriage and features a roller or ball body. This is arranged in a receptacle on the carriage, between the carriage and wall of the rod, wherein the receptacle similar to the inclined recess or inclined wall is provided on the interior of the rod wall. This roller or ball body can be supported in the receptacle in a manner such that it slips off the inclination when the holder moves upwards and hence it does not hinder the motion. When the holder moves downwards, it is pressed into the inclination, in particular through friction caused by lying on the wall of the rod, and hence the frictional effect will be increased in this direction.

Alternatively to a mechanical freewheeling device with roller or ball bodies, a hydraulic freewheeling device can be provided. In this way, the carriage is sealed against the internal side of the wall or the internal cross-section of the rod and the rod is entirely filled with a liquid, advantageously a liquid like oil. The carriage features a straight-way valve, so that, when the carriage moves inside the rod, liquid exchange between the two partitions inside the rod formed by the carriage can take place. This straight-way valve, during the downwards motion of the carriage, features a higher resistance to flow or a smaller flow cross-section area than when the carriage moves upwards. Such a straight-way valve, for instance, can be formed by means of differently shaped lamella or non-return valves or similar elements.

In accordance with a simple embodiment of the invention, a holder can essentially be disposed in a single position on the rod, thus in a displaceable and under certain circumstances also in rotatable manner, but, otherwise, in its angular alignment. Swiveling of the shower device can be made possible by means of an articulated joint on the holder of a part that holds the shower device.

In a somewhat complex embodiment of the invention, the holder can be made capable of swiveling to a greater extent relative to the rod. For this, several magnets can be disposed on two opposite sides of the carriage and the holder features a holding section that encloses or overlaps the rod. This enclosure, for instance, can be provided with a collar-type holding section in which an opening is provided. Such an opening in the holding section is at least section-wise significantly greater than the rod itself, in order to create the swiveling possibility. Particularly advantageously, the opening transforms from a narrow part that, for instance, corresponds essentially to the external cross-section of the rod into a part far away and forms an expansion. This expansion extends preferably in a swivel plane of the holder and particularly preferably the opening extends upwards into the expansion, so that a lower end of the holder is swiveled out less than the upper end.

Moreover, it is possible that the magnets on the carriage lie in the swivel plane of the holder. The holder itself likewise features magnets, and particularly on a rear side and a front side, and approximately in the swivel plane, so that they respectively lie on the carriage opposite the corresponding magnets, viewed in the swivel plane. Two swivel positions of the holder can be defined in that the holder lies on the rod respectively with the front or rear end of the opening. In a first swivel position, the magnets lie on the rod on the front side of the holder and in a second swivel position, the magnets lie on the rod on the rear side of the holder. In this way, the holder in the second swivel position is swiveled further away from the rod, so that, a shower device fixed on it is likewise advantageously further away from the rod and features a different angle.

Alternatively, the holder can be swiveled in a swivel plane in a different manner relative to the rod. In addition, magnets can be disposed on one side or on both sides of the carriage with equal or maximum distance apart from the swivel plane particularly they are disposed outside the swivel plane, with magnets on both sides, symmetrically to the swivel plane. Magnets are respectively disposed on the holder opposite one another, in one or even two rows, on the side of the rod such that several rows are provided here, which, based on the swivel position, lie exactly opposite the magnets on the carriage. This means that all magnets are outside the swivel plane and in each swivel position, further swiveling or back-swiveling through the magnetic force is prevented, which, at the same time, secures the holder against slipping downwards.

On the one hand, a rod can be formed as a tube with a rounded cross-section, for instance, with a circular cross-section. Alternatively, an angular cross-section can be provided, for instance, a flat rectangular cross-section. In yet another embodiment of the invention, the rod is not a closed tube, but is formed, for instance, like a U-profile, wherein the leg, under certain circumstances, can also be very short. Advantageously, a U-profile is formed with an undercut, so that a carriage with a clamping effect can be held inside, in order to prevent slippage and lose. However, within the scope of this application, also the above-mentioned profile is termed as a rod, and the invention can be implemented with it, and, under certain circumstances, even a flat profile is termed as a rod.

This and further features besides the claims are derived also from the description and drawings, wherein individual features are respectively implemented by themselves alone or are combined to several features in the form of sub-combination in an embodiment of the invention and in other fields and can depict advantageous as well as patentable embodiments for which protection is sought here. The subdivision into individual sections and between titles does not limit the statements made under them in their general validity.

SHORT DESCRIPTION OF THE DRAWINGS

Figure 1:
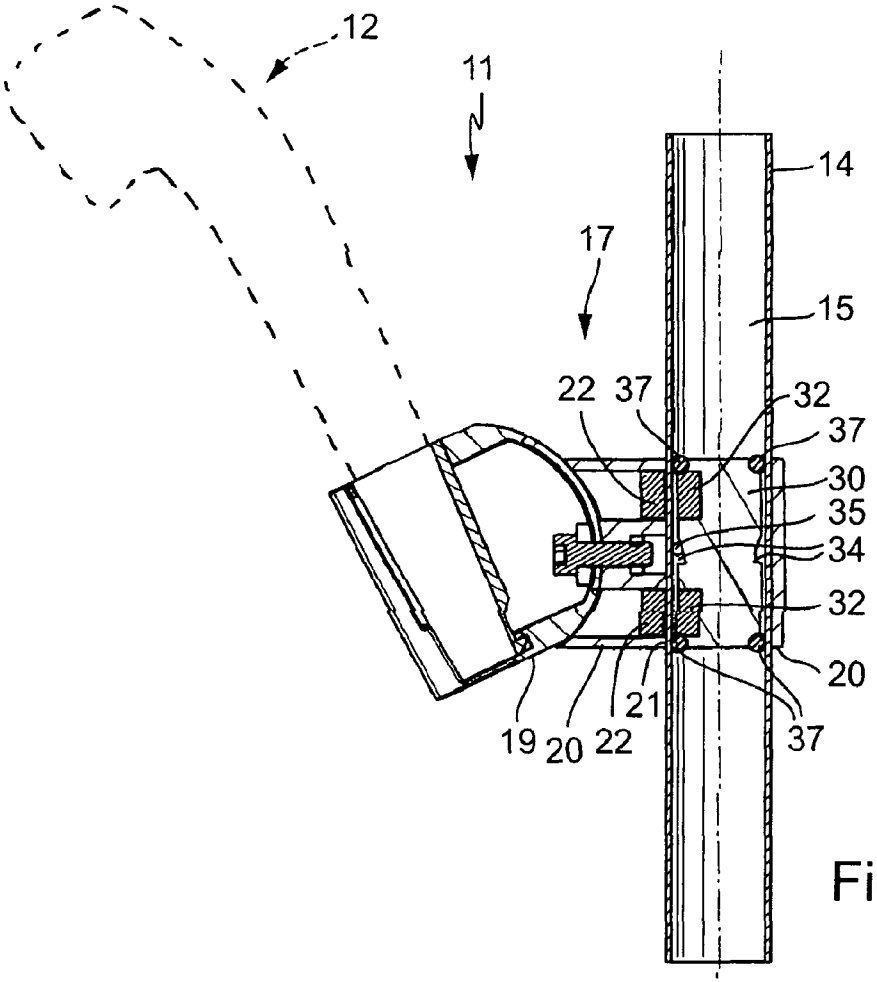
Figure 3:
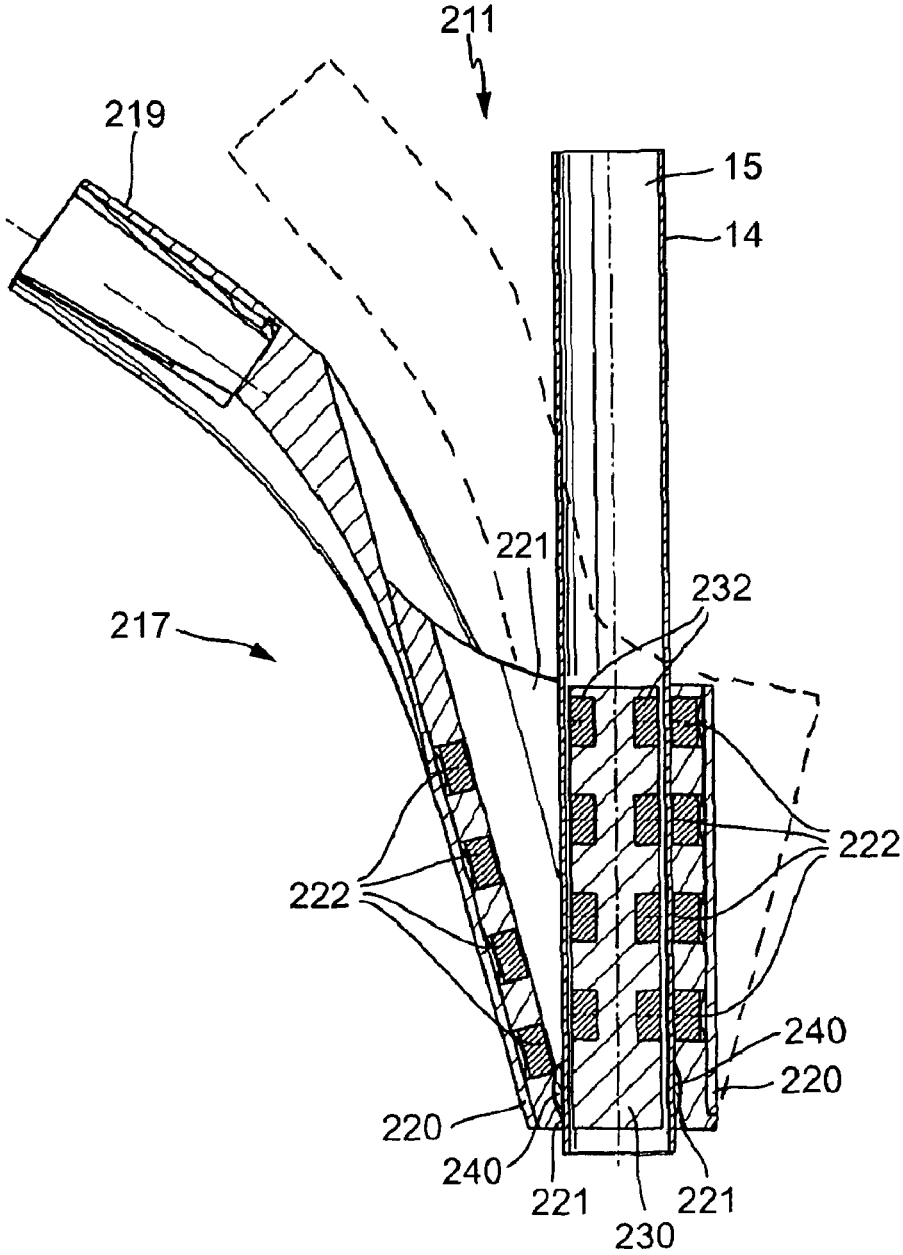
Figure 3:
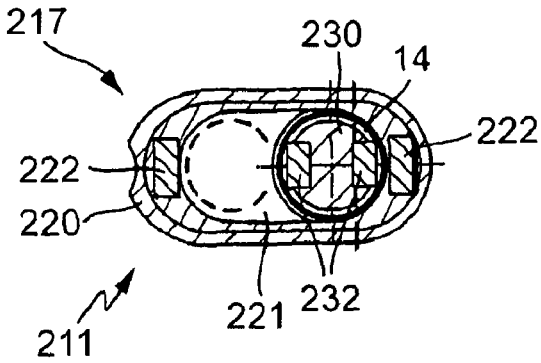
Figure 4:
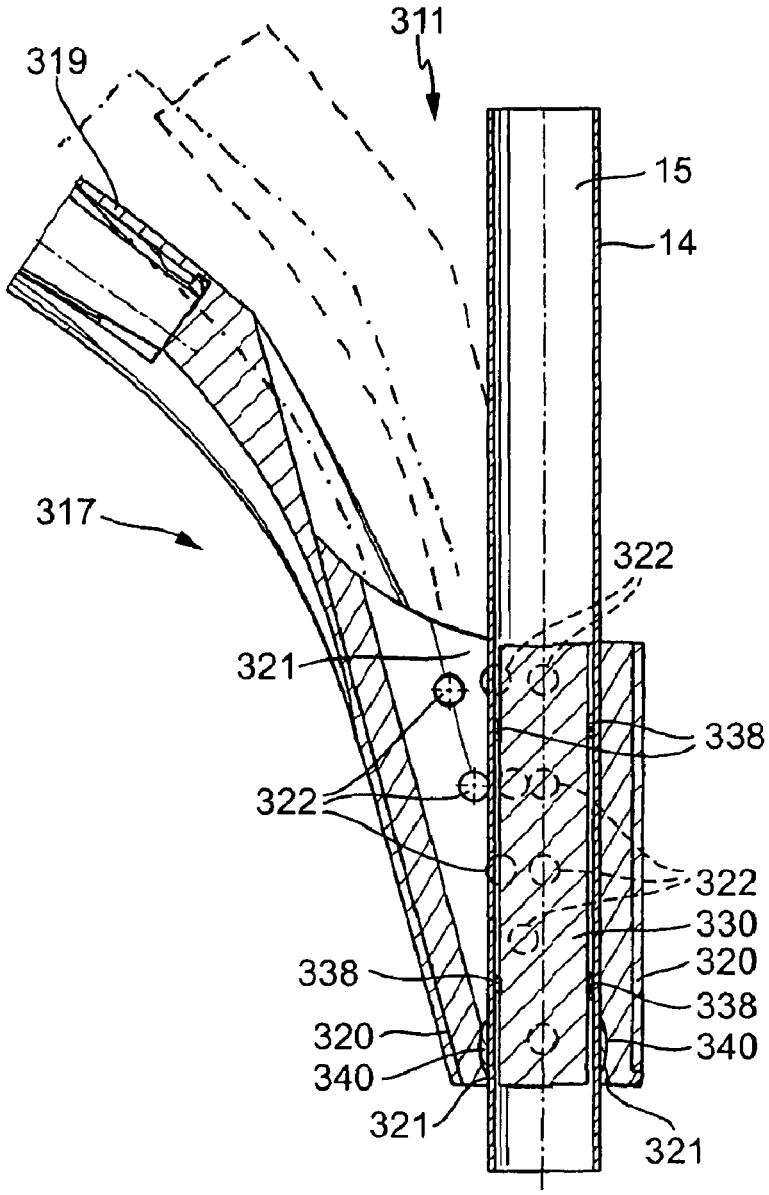
Figure 4:
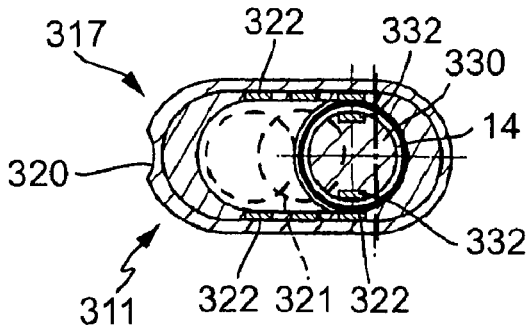

Exemplary embodiments of the invention are schematically depicted in the drawings and are explained below in detail. The following details are shown in the drawings:

FIG. 1 shows a lateral sectional illustration of a first holding device for a hand-held shower device on a rod with a magnetic holder FIG. 2 shows a modification of the holding device in FIG. 1 in simplified version, FIG. 3 shows an alternative holding device that can be swiveled in two positions on the rod and FIG. 4 depicts a further modification of the holding device in FIG. 3 with three swivel positions.

DETAILED DESCRIPTION OF THE EXEMPLARY EMBODIMENTS

FIG. 1 shows a holding device 11 for a hand-held shower device 12, depicted as dashes, with a rod 14. The rod 14 can be attached in a normal manner to a wall—not depicted here—for instance, it can be screwed on both ends. The rod features an interior space 15 and is a closed pipe with circular cross-section and a small wall thickness.

The holding device 11 features a holder 17 with a clamping part 19 protruding towards the left, in which the lower part of the hand-held shower device 12 can be stuck or clamped in the normal manner for holding purposes. The clamping part 19 is attached in a slidable manner to a holding section 20. The holding section 20 features an opening 21 towards the right and encloses the rod 14 in a collar-like manner. In this way, the opening 21 is insignificantly larger than the rod 14, so that the holder 17 can be shifted along the rod 14 without significant friction. Additional coating or rubber parts that increase the friction on the interior of the opening 21 can be provided, in particular in FIG. 1, left, on the opening. This will be discussed later in detail.

The holding section 20 features two magnets 22 disposed over one another, for instance, permanent magnets, which are disposed along an axis, which runs parallel to the dash-dotted middle-longitudinal axis of the rod 14. The magnets 22 are attached with very small distance to the rod 14 or are covered only by a thin material area of the holding section 20.

In the rod 14, at the height of the holder 17 there is a carriage 30 with a cross-section, which is a bit smaller than that of the interior spaces 15 of the rod 14, but from the shape, it corresponds to the latter. The carriage 30 features two magnets 32, which are approximately as large as the magnets 22 in the holder 17 and exactly disposed opposite the latter, thus also along straight lines parallel to the middle longitudinal axis of the rod 14. The carriage 30, for instance, can be made of plastic, in particular an injected plastic part. The magnets 32 can either be injection-molded in place or be pressed subsequently into the respective recesses or they can be glued in place. As explained above, it is possible, either to replace only the magnets 22 or only the magnets 32 by magnetic or ferromagnetic elements, for instance, iron pieces. With this, the magnetic attractive force can still be attained for holding on the rod 14.

At about half the height, the carriage 30 features a surrounding inclined groove 34, with a form that is inclined upwards towards the outside of the carriage 30 and is rectangular at the bottom. Inside the groove 34, there is a ball 35. The groove 34 and ball 35 form a kind of freewheel for the carriage 30 in the sense that, during an upwards motion of the carriage 30, the ball 35 sits loosely inside the groove. During downwards motion the ball is clamped between the inclination of the groove 34 and the interior side of the rod 14 and hence increases the frictional effect here, which opposes smooth downwards movement of the carriage 30. For this purpose, the ball 35 can advantageously have a strongly abrasive surface, for instance, some kind of a rubber surface. In addition, on the upper and lower end of the carriage 30, rubber rings 37 are fitted for additional frictional effect.

From FIG. 1 it is easy to detect that, in the depicted position, the magnets 22 of the holder 17 and the magnets 32 lie opposite the carriage 30 and attract one another. Owing to a relatively high internal friction of the carriage 30 inside the rod 14, the carriage 30 does not easily slip downwards. The holder 17 on the other hand is held by the magnetic force on the carriage 30 and is as such also secured against slipping downwards even with an inserted hand-held shower device 12 together with outgoing shower hose—non-depicted.

According to the invention, it can even be provided that through the attractive force between the magnets 22 and 32, the carriage 30 is pulled more strongly towards to the left of the holder 17 and hence it is pressed more strongly against the internal side of the rod 14. Thus, the friction is increased so that the carriage 30 and the holder 17 coupled with it magnetically, together with the hand-held shower device 12, do not slip downwards.

By using the rubber rings 37 as well as other devices that influence friction or causing the freewheel effect in the form of the groove 34 and the ball 35, it is achieved that frictional force of the carriage 30 inside the rod 14 is not influenced or is only influenced slightly by common production tolerances. On the contrary, for instance, through the magnetic attraction of the carriage 30 in the rod 14, a relatively exactly defined or definable friction can prevail towards the left, which is generally independent of production tolerances and which, under certain circumstances, also makes adjustment work unnecessary.

Instead of the freewheel depicted in FIG. 1 with the groove 34 and ball 35 as a mechanical freewheel, a longitudinal hole could be provided through the carriage 30, for instance, through its middle axis. A straight-way valve with exactly defined passage properties can be provided inside the latter. The entire rod 14 is then filled with a fluid, for instance, oil and closed on both ends. If the carriage is now moved upwards or downwards, then the fluid must be passed through the passage valve so that again a kind of frictional effect or braking effect of the carriage prevails in the interior of the rod.

Such a passage valve could be formed such that it easily allows an upward motion of the carriage with fluid flow direction from the top to the bottom, through the carriage, than allowing a motion in the reverse direction. For instance, it can be easier to shift the holding device 11 upwards than downwards. This can be realized either through a passage valve with different properties in both directions or through two passage valves, which only allow fluid to pass in the opposite direction, however, for a smoother upward carriage movement, a greater passage cross-section is provided than for a downward movement.

A further advantageous effect of the rubber rings 37 does not lie only in the increased friction or holding effect, but rather because they prevent the carriage from dropping down inside the rod 14, when the holder 17 is not yet attached to the rod 14 or is removed or the magnetic coupling between the magnets 22 inside the holder and the magnets 32 inside the carriage 30 is interrupted. Therefore the friction of the rubber rings 37 in the rod 14 should be adequately great in order to hold the weight of the carriage 30.

A particularly simple embodiment of a carriage 130 is depicted in FIG. 2 in a holding device 111, which again is disposed on the same rod 14 as in FIG. 1. Also the holder 17 is formed as depicted in FIG. 1. The difference is not only in the carriage 130 that features neither a groove nor a ball nor rubber rings as in FIG. 1. Several rubber pads 138 are provided only on the side facing towards the left of the holder 17 and are inserted in or attached to the carriage 130. They are, on the one hand, very thin so that a distance between the magnets 22 and 132 is as small as possible for a possibly great magnetic force. At the same time, they generate a great friction especially through the attractive force of the magnets between the carriage 130 and interior side of the rod 14, in order to avoid slippage of the holding device 111 on the rod 14.

In FIG. 3 is a further holding device 211 disposed on a rod 14 as was done earlier on. The holder 217 features a clamping part 219 that again points towards the left and in which, similarly to FIG. 1, a hand-held shower device—not depicted—can be stuck. The clamping part 219 transforms as a single piece into a holding section 220, which encloses the rod 14. This can be detected also besides the side section at the top in FIG. 3, in the cross-section at the bottom in FIG. 3. Although it can be seen in FIG. 2 that the clamping part 219 forms a kind of external shell in which an internal part is inserted. This is only done so in the present example due to production reasons, but not as a compulsory measure. In so far, the part enclosing the rod 14 in FIG. 3 is a holding section 220.

As it is visible, above all, from the bottom illustration in FIG. 3, an opening 221 in the holding section 220 features a form that depicts the width of the rod 14, although it is expanded towards the left, upwards up to approximately double the diameter of the rod 14. From that, as depicted with dashed lines, it can be seen that the holder 217 can be swiveled towards the rod 14 with two end positions on the left—depicted with continuous lines and towards the right depicted in dashed lines.

On the holding section 220, the magnets 222 are disposed along a line running parallel to the longitudinal middle axis of the rod 14 and thus, respectively four pieces are superimposed. Moreover, when viewed from the top, four magnets 222 are disposed along the left external extension of the opening 221 or are fixed in the holding section 220. There are two rows of magnets 222. In the lower area the holding section 220 features a flat and broad surrounding plastic or rubber ring 240. This is disposed in a corresponding recess on the internal side of the holding section 220. It can on the one hand improve the frictional effect of the holder 217 on the rod 14 in order to prevent slippage downwards. Moreover, under certain circumstances, also with low friction, it can act as a kind of rotary joint for swiveling the holder 217 on the rod 14, in order to compensate a mechanically necessary clearance in the opening 221.

At the height of the holding section 220, the carriage 230 is located inside the rod 14. This carriage 230 is similar to that depicted in FIG. 2, wherein it features more magnets 232, thus four magnets 232 over one another. Moreover, these magnets 232 are not only provided on the part of the carriage 230 facing towards the left, but rather also on the part facing towards the right, as it is moreover well apparent at the bottom in FIG. 3. Rubber pads that correspond to those in FIG. 2 can be provided to reinforce the frictional effect. Moreover, naturally, also in such a carriage 230, a kind of freewheel similar to that in FIG. 1 can be provided.

As can be seen well in FIG. 3, in the continuous-line drawn swivel position of the holder 217, fully towards the left of the part of the holding section 220, which, in FIG. 3, faces the right, is pressed against the rod 14 along its length. In this way, the magnets 222 and 232 act together to keep the holder 217 on the carriage 230 or in said position.

Through the attractive force of the magnets, the carriage 230 is again pressed into the rod 14, towards the right, against the internal wall similar to the holding section 220, in this area, from outside, against the external wall of the rod 14. The frictional effect is thus increased and slippage of the holding device 211 downwards is prevented.

In the dashed swivel position of the holder 217, extreme right, the left area of the holding section 220 is pressed against the rod 14. In this way, the left magnets 222, and the left magnets 232 lie opposite the carriage 230. The prior described holding effect for the swivel position on extreme left, now adjust accordingly. Above all, also in the swivel position towards the right, the magnetic effect prevents returning back to the position depicted in continuous lines.

A further holding device 311 is depicted in FIG. 4. A holder 317 features a clamping part 319 projecting towards the left in similarity to that in FIG. 3. A holding section 320 again similar to that depicted in FIG. 3 adjoins this and encloses the rod 14. In the holding section 320, several magnets 322 are provided, as this can be seen also in the lower plan view. In this way, the magnets 322 are provided along the three lines that meet near the height of the lower rubber ring 340, thus, near a swivel axis. Owing to the formation of the holding section 320 with the opening 321, the holder 317 can again be swiveled on the rod 14. However, as depicted in FIG. 3, not only two swivel positions are possible, namely, in the respective extreme ends of the swivel motion, wherein the right dashed line is depicted, but rather an additional intermediate position depicted in dash-dotted lines. For this, the carriage 330 is basically relatively formed in a similar manner to the carriage 230 in accordance with FIG. 3. However, the two rows of several magnets are not oriented towards the left and right in the drawing plane, but towards the front and rear, as depicted at the bottom in FIG. 4. The carriage from FIG. 3 is thus rotated by 90°.

On both sides of the magnets 332 in the carriage 330, the magnets 322 are located on the holder 317 in each of the three swivel positions and thus secure this swivel position. It is clear in this arrangement that the force, with which the carriage 330 is attracted to the holder 317 or to the holding section 320 enclosing it, is cancelled by the arrangement of the magnets 222 and 322 on either side, so that no magnetically caused clamping effect occurs on the rod 14. To offset the absence of this clamping effect for increasing the frictional effect against downward slippage of the holder 317 on the rod 14, the carriage 330 again features rubber pads 338, as they were already described earlier in FIG. 2.

In a modification of the embodiment from FIG. 4, the magnets on the carriage and cannot be provided on both sides on the holder, but rather only on one side. When these magnets are accordingly strong, then still a sufficiently strong magnetic force shall available to keep the holder from slipping downwards on the carriage. At the same time, the increase of the clamping effect on the rod 14 can be achieved in between with an increase of the frictional effect.

What is claimed is:

1. A holding device supporting a shower device on a rod, wherein said rod is attachable to a surface and features an interior space, wherein said holding device on said rod features an attachable holder for said shower device, wherein said holder is movable along said rod, wherein a carriage is disposed in a slidable manner inside said rod, wherein said carriage features at least one of a magnet and a magnetic element subject to magnetic attraction, and wherein said holder features at least one of a magnet and a magnetic element subject to magnetic attraction, wherein said holder engages on said rod in such a manner that, in a holding position, said one of the magnet and magnetic element of said carriage interacts under a magnetic attractive force with said one of the magnet and magnetic element of said holder and thereby prevents said holder from slipping along the rod as a result of said magnetic attractive force.

2. The holding device according to claim 1, wherein at least one said magnet on said carriage and at least one said magnet on said holder are disposed at a small distance from one another in said holding position.

3. The holding device according to claim 1, wherein along a displacement direction of said carriage on said rod at least two magnets are provided on said carriage with a distance between them.

4. The holding device according to claim 3, wherein said two magnets are provided each on of two ends of said carriage, wherein each of said magnets on said carriage can be attracted to an opposite magnet on said holder.

5. The holding device according to claim 1, wherein the holder engages on the rod with a frictional effect at least partly due to one of permanent frictional resistance and a frictional brake.

6. The holding device according to claim 5, wherein said frictional effect is provided in part from frictional material pressed from inside against said rod.

7. The holding device according to claim 5, wherein said frictional effect is activated in part by said magnetic attractive force in said holding position.

8. The holding device according to claim 7, wherein at least one of projections and sections of the frictional material, in an area around at least one said magnet on said carriage, are disposed such that they are pressed against an internal wall of said rod during magnetic interaction with said holder attached to said rod on said carriage.

9. The holding device according to claim 1, further comprising a frictional brake provided on said holder for creating a frictional effect between said holder and said rod.

10. The holding device according to claim 1, wherein the rod is attachable to extend at least partly vertically on the surface and further comprising a freewheeling device that makes motion of said holder together with said carriage easier upwards than downwards, wherein said freewheeling device is active in a displaced position of the holder.

11. The holding device according to claim 10, wherein said freewheeling device comprises rolling bodies disposed in a receptacle on said carriage, wherein said receptacle features an inclined wall towards an internal surface of said rod.

12. The holding device according to claim 10, wherein said freewheeling device comprises a hydraulic freewheel with a seal on said carriage against an internal surface of said rod, wherein liquid is contained inside said rod above and below said carriage, wherein said carriage features a straight-way valve, wherein said straight-way valve features a smaller flow cross-section area in a downwards than in an upwards direction of said carriage motion.

13. The holding device according to claim 1, wherein said magnets are disposed on two opposite sides of said carriage and said holder features a holding section that encloses said rod with a collar-type holding section having an opening in said holding section, wherein said opening in said holding section is at least section-wise larger than said rod, sufficiently to permit moving and swiveling said holder.

14. The holding device according to claim 13, wherein said opening transforms upwards into an extension, wherein said extension extends in a swivel plane of said holder.

15. The holding device according to claim 14, wherein said magnets on said carriage lie in said swivel plane and said magnets are disposed on a front side and rear side of said holder in said swivel plane such that the magnets respectively lie opposite said corresponding magnets on said carriage, wherein two swivel positions of said holder are defined, including a first swivel position wherein said magnets on said front side contact said rod and a second swivel position wherein said magnets on said rear side contact said rod, wherein said holder in said second swivel position is swiveled further down from said rod.

16. The holding device according to claim 14, wherein said holder is structured to be swiveled relative to said rod in said swivel plane in different swivel positions, wherein said magnets are disposed on both sides of said carriage at a same distance from said swivel plane and respectively on said holder, opposite magnets are disposed laterally adjacently, wherein in a plane parallel to said swivel plane, several similar rows of magnets are provided on said holder respectively, in which said magnets lie on the carriage in a different swivel position.

17. The holding device according to claim 14, wherein said rod features a rectangular cross-section.

18. The holding device according to claim 1, wherein said rod features a rounded cross-section as a tube.

* * * * *